US006502481B1

(12) United States Patent
Lin

(10) Patent No.: US 6,502,481 B1
(45) Date of Patent: Jan. 7, 2003

(54) SAFE AND QUICK BOTTLE OPENER FOR REMOVING A CORK STOPPER

(76) Inventor: Chia-Hsien Lin, PO Box 82-144, Taipei (TW)

( * ) Notice: Subject to any disclaimer, the term of this patent is extended or adjusted under 35 U.S.C. 154(b) by 0 days.

(21) Appl. No.: 09/976,089

(22) Filed: Oct. 15, 2001

(51) Int. Cl.[7] ..... B67B 7/00
(52) U.S. Cl. ..... 81/3.2; 81/3.48
(58) Field of Search ..... 81/3.09, 3.36, 81/3.29, 3.48, 3.49

(56) References Cited

U.S. PATENT DOCUMENTS 3,085,454 A * 4/1963 Federighi ..... 81/3.2
4,317,390 A * 3/1982 Nakayama ..... 81/3.2
4,464,956 A * 8/1984 Hashimoto ..... 81/3.2
4,791,834 A * 12/1988 Federighi ..... 81/3.2
5,005,446 A * 4/1991 Mackey ..... 81/3.48
5,012,703 A * 5/1991 Reinbacher ..... 81/3.2

* cited by examiner

*Primary Examiner*—Eileen P. Morgan
*Assistant Examiner*—Joni B. Danganan
(74) *Attorney, Agent, or Firm*—Leong C. Lei

(57) ABSTRACT

A safe and quick bottle opener for removing a cork stopper includes a hollow syringe in which a refrigerant can is disposed. A cap covers and is concealed in the syringe. The syringe has a slide sleeve sleeved thereon. The front end of the slide sleeve has an abutting seat for covering a bottle opening. The slide sleeve helps positioning a needle and conceals the needle to prevent slanting and breaking of the needle to thereby prolong the life of the bottle opener and protect the user's hand. After use, the bottle opener can be assembled as a whole to facilitate storage and carrying.

1 Claim, 5 Drawing Sheets

SAFE AND QUICK BOTTLE OPENER FOR REMOVING A CORK STOPPER

BACKGROUND OF THE INVENTION (a) Field of the Invention

The invention relates to a safe and quick bottle opener for removing a cork stopper.

(b) Description of the Prior Art

Bottles of wine or liquor are usually sealed by cork stoppers since cork can resume its original shape after being squeezed. Cork can prevent entrance of air into the bottle to help preserve the flavor of the wine in the bottle.

There are different kinds of bottle openers available in tie marketplace. FIG. 1 shows a conventional bottle opener for removing a cork stopper in a non-destructive and quick manner. A needle (A1) at the front end of a syringe (A) is inserted into and extended through a cork stopper. Then, a refrigerant can (C) is disposed in the syringe from the tail end. By pressing the refrigerant can (C) lightly for a few seconds, the refrigerant gas will cause the positive pressure within the bottle to augment to thereby push out the cork stopper.

However, there are certain disadvantages with the conventional bottle opener:

1. The size of the needle is rather small, and may easily break when not held properly. The broken needle may hurt the user's hand.
2. As the size of the needle is rather small, the user may feel unsafe when using the bottle opener, which may affect the balance of the hand when the user applies a force, resulting in greater likelihood of breaking of the needle.
3. In order for the needle to pass through the cork stopper, the needle has to be pressed downwardly until the syringe end covers the bottle opening, as the user ascertins the central position of the cork stopped with his/her naked eyes, if the needle slants to one side, the syringe end cannot smoothly cover the bottle opening so that the subsequent inflating operation cannot proceed smoothly. In case of forced displacement, the needle may deform or even break.
4. The syringe and the refrigerant can are separately stowed, either of which may be misplaced.

SUMMARY OF THE INVENTION

The invention relates to a safe and quick bottle opener for removing a cork stopper.

Accordingly, the primary object of the present invention is to provide a safe and quick bottle opener for removing a cork stopper, in which a syringe is fitted with a slide sleeve for positioning the needle and conceals the needle so that the needle will not easily slant or break to thereby prolong the life of the bottle opener and protect the user's hand.

Another object of the present invention is to provide a safe and quick bottle opener for removing a cork stopper, in which, after use, the bottle opener can be assembled as a whole to facilitate storage and carrying.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
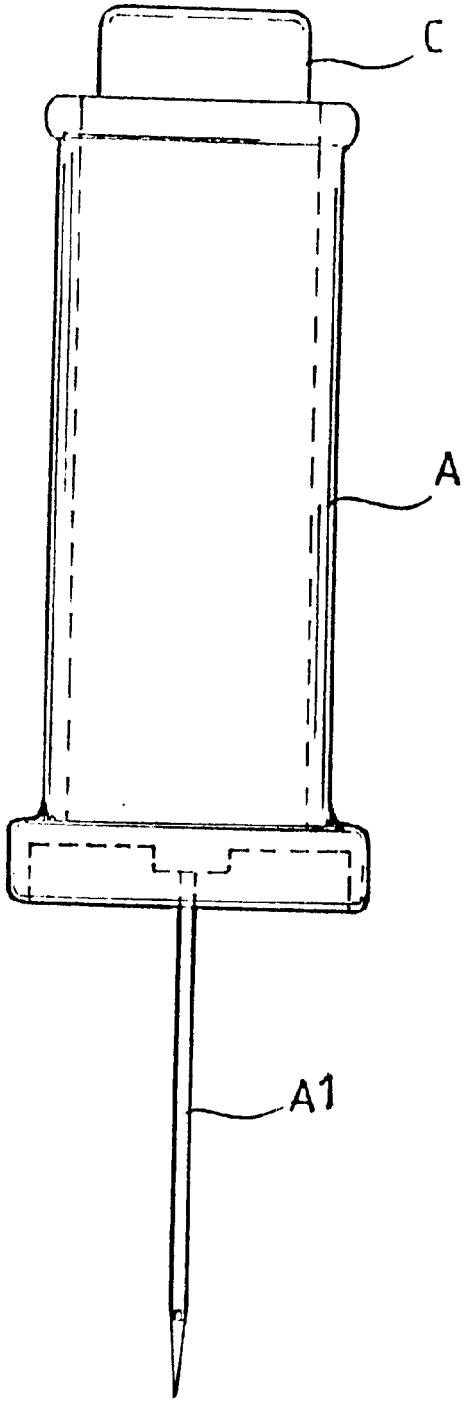
PRIOR ART FIG. 1
FIG. 1 illustrates a conventional bottle opener for removing a cork stopper.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 2:
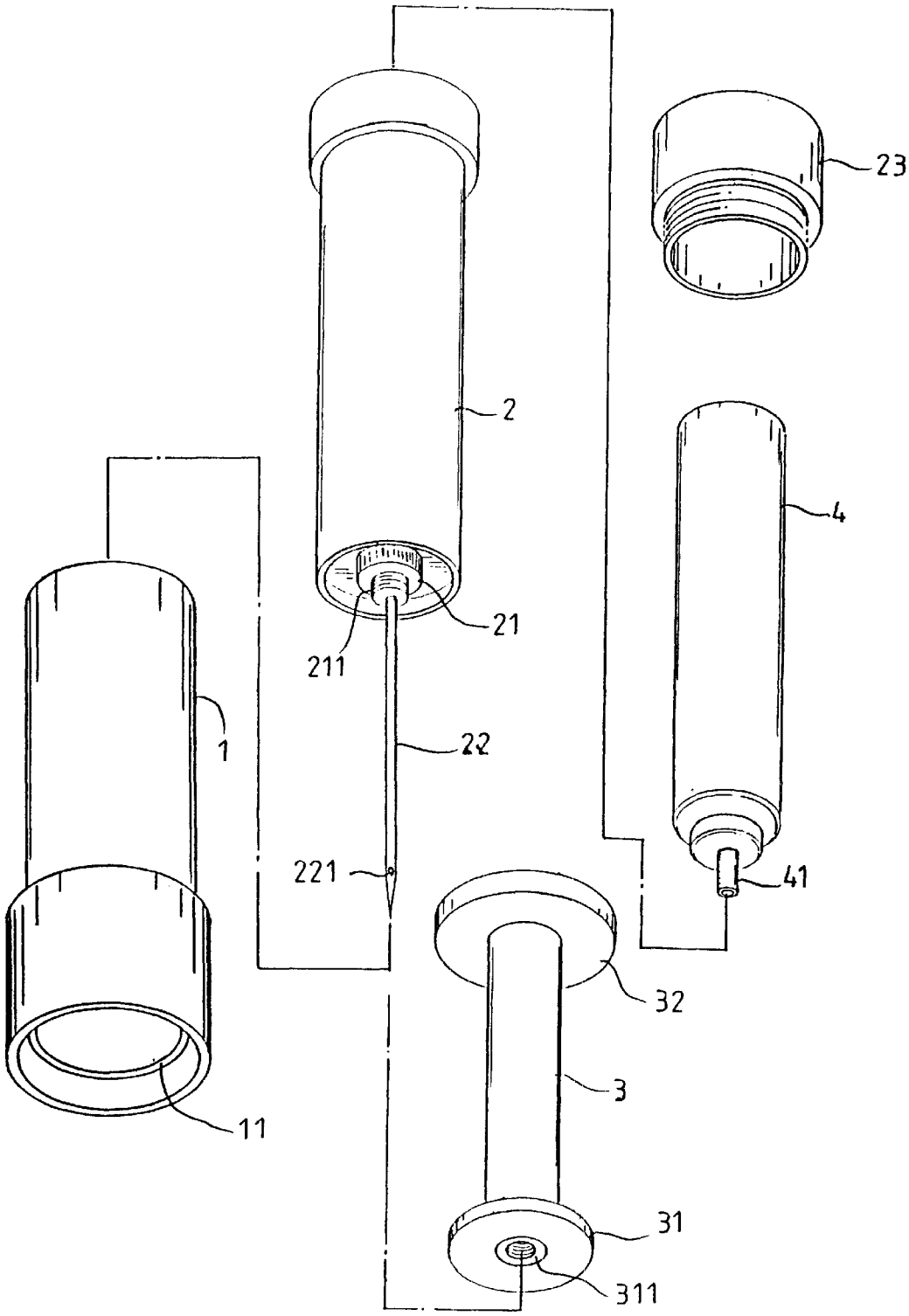
FIG. 2 is an exploded perspective view of the present invention.
Figure 3:
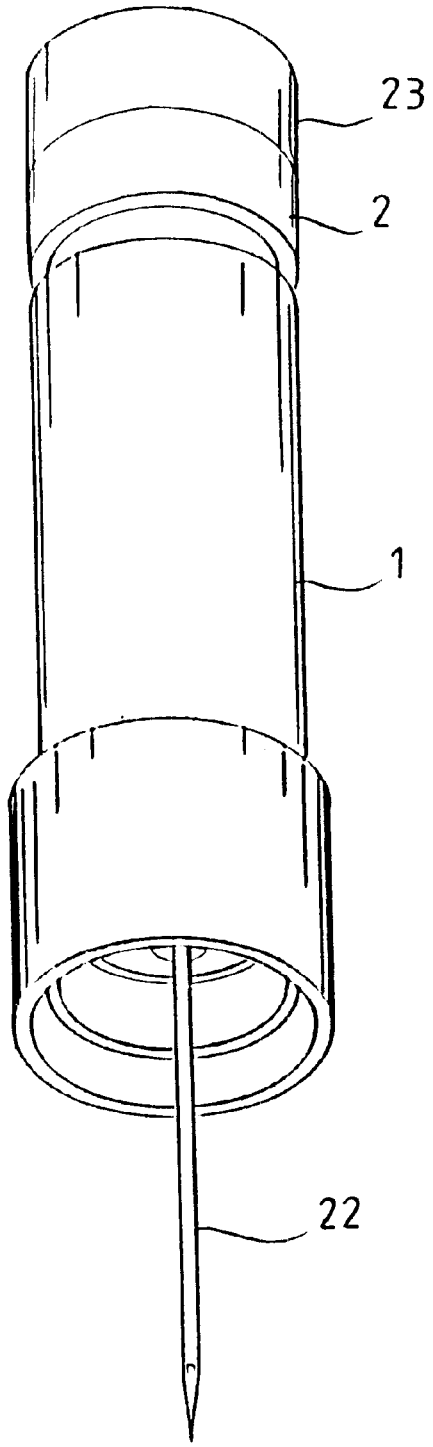
FIG. 3 is an assembled perspective view of the present invention.

Referring to FIGS. 2 and 3, a safe and quick bottle opener for removing a cork stopper according to the invention includes a syringe 2, a slide sleeve 1, a refrigerant can 4, and a needle cover 3.

The syringe 2 is a hollow cylindrical structure that has a front end with a needle seat 21 fixedly provided with a suitably long needle 22, and a rear end with a rotary cap 23 that seals the opening of the syringe 2. The rotary cap 23 can be secured by threaded engagement or tight fit. The front end of syringe 22 is provided with at least one through air vent 221.

The slide sleeve 1 has an internal diameter similar to the external diameter of the syringe 22 such that the slide sleeve 1 can be sleeved on the syringe 2 and both can freely rotate relative to each other. The front end of the slide. sleeve 1 is provided with an abutting seat 11 which is sized to match the opening of most bottles and which is adapted to cover and abut against the bottle opening to help positioning the bottle opener.

The refrigerant can 4 is an air can filled with a stable, non-toxic gas such as refrigerant, oxygen, etc. at high pressure, and which is disposed in the hollow interior of the syringe such that a nozzle 41 of the refrigerant can 4 abuts against the needle 21 from inside. In addition, the refrigerant can 4 projects a certain distance from the syringe.

Figure 4:
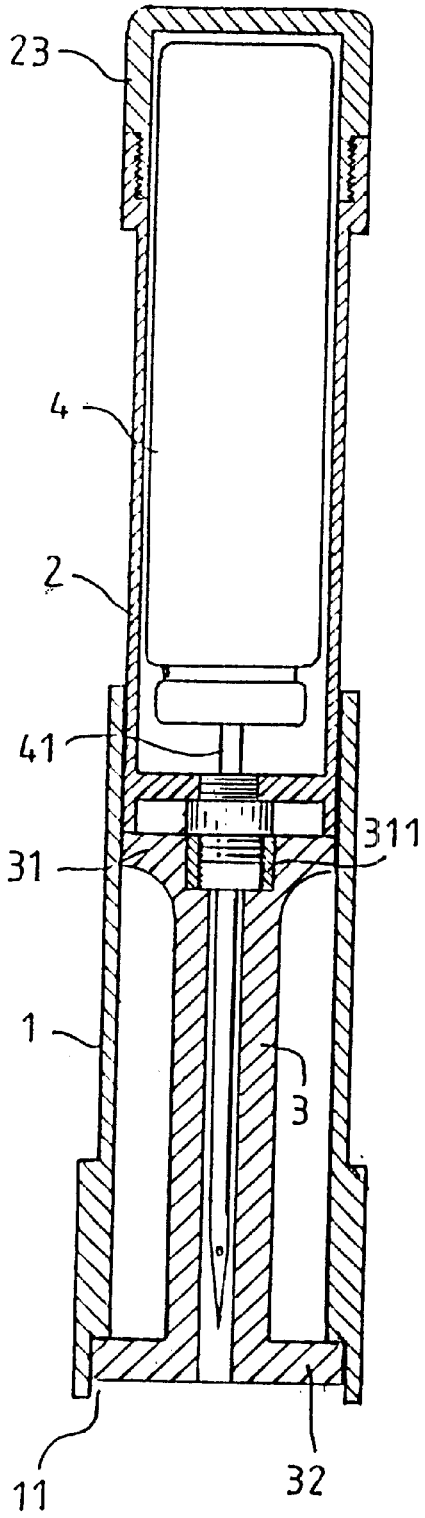
FIG. 4 is a sectional view of the present invention in a stored state.

The needle cover 3 has a total length slightly longer Man that of the syringe 22 and has two ends provided with flanges. The center of the first flange 31 is provided with an inner thread 311 for engaging an outer thread 211 of the needle seat 21, and abuts against the periphery of the syringe to stabilize the needle cover 3. The diameter of the second flange 32 is equivalent to that of the abutting seat 11. After using the bottle opener and the components are assembled, as shown in FIG. 4, the needle 22 of the syringe 2 can be received within the slide sleeve 1 to form a neat and safe structure for convenient carrying.

Figure 5A:
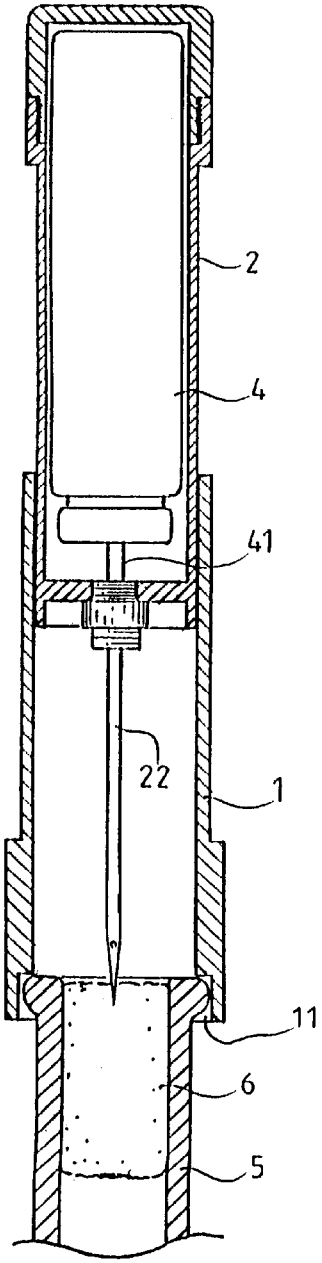
FIGS. 5*a* and 5*b* are sectional views of the present invention in a state of use.
Figure 5B:
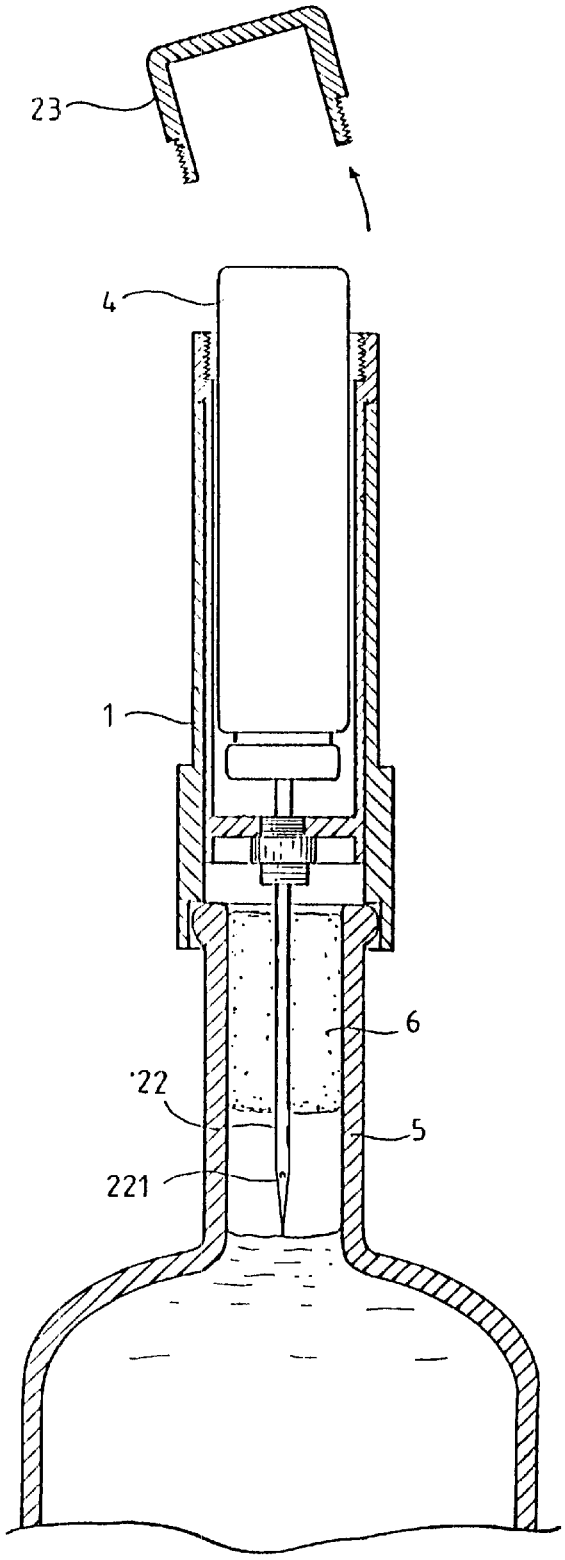

Referring to FIG. 5*a,* in use, the needle cover 3 is removed, and the abutting seat 11 of the slide sleeve 1 is used to cover and abut against the opening of a bottle 5. At is time, the needle 22 is located at the center of a cork stopper 6. Then, a pressure is applied to the rear end of the syringe 2 to cause the needle 22 to extend through the cork stopper until the travel of the needle 22 ends, and the pointed end of the needle 22 is substantially located in the space between the cork stopper 6 and the wine in the bottle 5, as shown in FIG. 5*b.* Then, the rotary cap 23 is removed to expose the tail portion of the refrigerant can 4. Finally, the refrigerant can 4 is pressed lightly so that the high-pressure gas inside is released, and the gas is released via the needle 22 through the air vent 221 into the interior of the bottle to result in the generation of a positive pressure within the bottle to push out the cork stopper quickly and easily.

As compared to the prior art, the present invention achieves the following advantages:

1. The present invention uses the abutting seat of the slide sleeve for positioning purposes to ensure that the needle is located at a substantially ideal central position, to prevent slanting of the needle and to prolong the life of the bottle opener.
2. The use of the syringe in combination with a slide sleeve can protect the hand during opening even if the needle accidentally breaks.
3. As the needle is covered and is almost not visible to the user when in use, the user will not feel uncomfortable.
4. After use, the present invention can be assembled and stowed as a whole, unlike the prior art in which the refrigerant can and the syringe are separately stowed, and is therefore convenient to carry and store.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A safe and quick bottle opener for removing a cork stopper, comprising:

a syringe which is a hollow cylindrical structure that has a front end with a needle seat fixedly provided with a suitably long needle, and a rear end with a rotary cap that seals an opening of the syringe, the front end of the syringe being provided with at least one through air vent;

a slide sleeve having an internal diameter similar to the external diameter of the syringe such that the slide sleeve can be sleeved on the syringe and both can freely rotate relative to each other, the front end of the slide sleeve being provided with an abutting seat which is sized to match the opening of most bottles and which is adapted to cover and abut against the bottle opening to help position the bottle opener;

a refrigerant can which is an air can filled with a stable, non-toxic gas at high pressure, and which is disposed in the hollow interior of the syringe such that a nozzle of the refrigerant can abut against the needle seat from inside, and the refrigerant can projects a certain distance from the syringe; and a needle cover having a total length slightly longer than that of the syringe and two ends provided with flanges, the center of the first flange being provided with an inner thread for engaging an outer thread of the needle seat and abutting against the periphery of the syringe to stabilize the needle cover; the diameter of the second flange being equivalent to that of the abutting seat, whereby when the components are assembled, the needle of the syringe can be received within the slide sleeve to form a neat and safe structure for convenient carrying.

* * * * *